United States Patent [19]

Ackerman et al.

[11] Patent Number: 4,638,846

[45] Date of Patent: Jan. 27, 1987

[54] METHOD OF MAKING THIN-WALLED DUCTILE IRON CASTINGS

[75] Inventors: Allen D. Ackerman, Troy; Conrad G. Perkey, Dearborn Heights; Robert A. Martin, Northville; William M. Justusson, Farmington Hills, all of Mich.

[73] Assignee: Ford Motor Company, Dearborn, Mich.

[21] Appl. No.: 164,867

[22] Filed: Jul. 1, 1980

[51] Int. Cl.[4] ..... B22D 27/00

[52] U.S. Cl. ..... 164/55.1; 164/133

[58] Field of Search ..... 164/55, 56, 57, 133, 164/350, 359, 360, 122, 363, 55.1, 56.1, 57.1

[56] References Cited

U.S. PATENT DOCUMENTS

| | | | |
|---|---|---|---|
| 451,578 | 5/1891 | Richards | 164/363 |
| 1,410,777 | 3/1922 | Thomes | 164/360 |
| 1,543,657 | 6/1925 | Bohn et al. | 164/359 X |
| 1,640,843 | 8/1927 | Magill | 164/359 |
| 1,746,467 | 2/1930 | Greiner | 164/55 X |
| 2,233,405 | 3/1941 | Fahlman | 164/359 X |
| 2,569,899 | 10/1951 | Miner | 164/359 |
| 2,997,757 | 8/1961 | Buhrer et al. | 164/350 X |
| 3,703,922 | 11/1972 | Dunks et al. | 164/57 |
| 4,040,821 | 8/1977 | Hetke et al. | 164/57 X |
| 4,057,098 | 11/1977 | Platonov et al. | 164/122 X |

FOREIGN PATENT DOCUMENTS

| | | | |
|---|---|---|---|
| 686810 | 9/1979 | U.S.S.R. | 164/55 |

*Primary Examiner*—Nicholas P. Godici

*Attorney, Agent, or Firm*—Joseph W. Malleck; Roger L. May

[57] ABSTRACT

A method is disclosed for making ductile iron castings having thin walls. Molten grey iron (preferably 3.5–4.2%C, 1.5–2.4% Si, and no greater than 0.65% carbide formers) is introduced to a mold assembly and nodularized/inoculated in such assembly prior to passing into the mold cavity of the assembly. The treated molten iron is fed into the mold cavity and into one extremity of a thin space thereof (0.2 inches thick or less and a length of at least 12 times the thickness). The treated molten metal is additionally mixed by vortical or turbulent flow immediately downstream of the treatment chamber as it is being conveyed to the mold cavity. While continuing to feed the treated molten iron to fill the mold cavity, a reservoir of the treated molten iron is created at a midstation of the thin space. The reservoir acts to conserve the heat of the molten metal and thus feed hotter molten metal to the remainder of the thin space and other connected cavity portions. The reservoir space also serves to define an integral functional part of the casting when solidified.

1 Claim, 6 Drawing Figures

METHOD OF MAKING THIN-WALLED DUCTILE IRON CASTINGS

BACKGROUND OF THE INVENTION

In the last decade, nodular (ductile) iron has become progressively more significant to the commercial casting industry because of its strength and other physical characteristics which can be enhanced by graphite shape control. One recent advance in the art of making ductile iron is treating the molten grey iron metal in the mold for the first time with a magnesium alloy resulting in better graphite nodularity. A granular nodularizing agent is placed in a well or treating chamber in the runner system to meet the hot metal poured into the mold. With this method, normal treatment for nodularization and/or inoculation in the ladle prior to pouring of the mold is eliminated.

Although in-the-mold treatment of grey iron to produce nodular (ductile) iron provides greater economy and improved quality, the state of the art has been unable to cast thin sectioned nodular castings with this method with reliable success. This lack of success is believed to be due to at least two aspects: (a) incomplete filling of the thin mold spaces which prematurely close shut by solidifying metal, and (b) excessive formation of carbides in the more quickly chilled thin spaces resulting in brittle castings and typically improper degree of nodularization.

SUMMARY OF THE INVENTION

The invention pertains to a method of making a thin-walled ductile iron casting that retains substantially the strength, hardness, ductility and high temperature properties of conventional thick walled iron castings. The formation of an undesirable solidification structure in the thin walled sections and premature cold shutting of the thin spaces defining such thin sections during metal pouring are the major obstacles to that goal. These obstacles are substantially overcome by using a method that combines in-the-mold nodularization/inoculation treatment with the use of a hot metal feed reservoir as part of the mold cavity to supply remote portions of the thin spaces.

The method essentially comprises introducing molten iron, of the type that would form grey iron with flake graphite if solidified untreated, to a mold assembly and, while in the mold assembly, treating with a nodularizing/inoculating agent prior to the molten iron passing to the mold cavity. Then the treated molten iron is fed into the mold cavity and into one extremity of a thin space that interconnects with other cavity portions. Finally, while feeding of molten iron is continued to fill the cavity, a reservoir of treated molten iron is created at a midstation of said thin space to feed molten iron to the remainder of said thin space and other connected cavity portions. The reservoir serves as an in-cavity hot metal feeder-runner to prevent cold shutting of the thin space and as an integral functional part of the casting when solidified. This method works particularly well when the thin space has a cross-sectional thickness dimension of 0.2 inches or less and a length of at least 12 times the thickness dimension.

To further enhance the physical properties of the casting, it is advantageous to control the chemistry of the introduced molten iron so that it contains 3.5–4.2% carbon, 1.5–2.4% silicon, no greater than 0.65% carbide formers, and the remainder essentially iron. It is preferable to employ a nodularizing/inoculating agent consisting of a magnesium/ferro/silicon alloy containing 5–6% Mg, with the remainder of generally equal proportions of iron and silicon. The alloy is preferably dissolved in the molten iron in an amount of 0.5–1%.

To provide even greater carbide control in the thin section of the casting, the runner carrying treated molten iron from the treatment chamber to the casting cavity preferably has walls oriented to induce vortical or turbulent flow therein. This uniformly stirs the reaction products of the agent and molten iron. The treatment chamber is also desirably formed as a cubicle having downwardly and inwardly sloping walls to compensate for the temperature differential between the leading and trailing flow conditions. Thus, when the chamber is filled with a treating agent to a predetermined level, the leading portion of the introduced molten iron flow will be nodularized and inoculated to substantially the same degree as the trailing portion of the introduced molten iron.

SUMMARY OF THE DRAWINGS

FIGS. 2 and 3 are sectional, elevational views, each of a portion of the gating system of the mold in FIG. 1, respectively taken substantially along lines 2—2 and 3—3 thereof;

DETAILED DESCRIPTION

The microstructure of various grades of as-cast ductile (nodularized) iron desirably consist of spheroidal graphite in a matrix of either ferrite, pearlite or martensite with a minimum of carbides. The relative amount of each of these constituents, including carbides, that will be present, depends on the condition of the treated molten metal and on the design of the casting cavity as it affects cooling rate and the method for carrying out nodularization and inoculation.

Nodularization and inoculation are time dependent effects. The closer the treatment to solidification, the better the effect. However, thin section castings create too fast a freezing rate and thus counteract the quality of prompt treatment by reducing the eutectic cell count and by promoting unwanted carbide formation.

Ductile iron castings having at least one thin wall section, and typically a plurality of such sections, present a difficult problem as to obtaining the desired amounts of ingredients in the microstructure because (a) such sections solidify rapidly causing an undesirable amount of carbide to be present in the section, and (b) the casting may not be fully defined because the space for defining such section is prematurely closed by cold metal, preventing molten metal from flowing therethrough.

The method herein uses a new approach to controlling the cooling rate of the metal in the thin section, and thereby the casting microstructure, through the combined use of in-the-mold nodularization/inoculation and use of an enlarged in-cavity feeder runner incorporated into the thin wall space of the molding cavity and which in-cavity feeder-runner is made an integral functional part of the casting cavity. The in-cavity feeder-runner ensures a steady supply of hot metal to the remote parts of the thin space.

Figure 1:
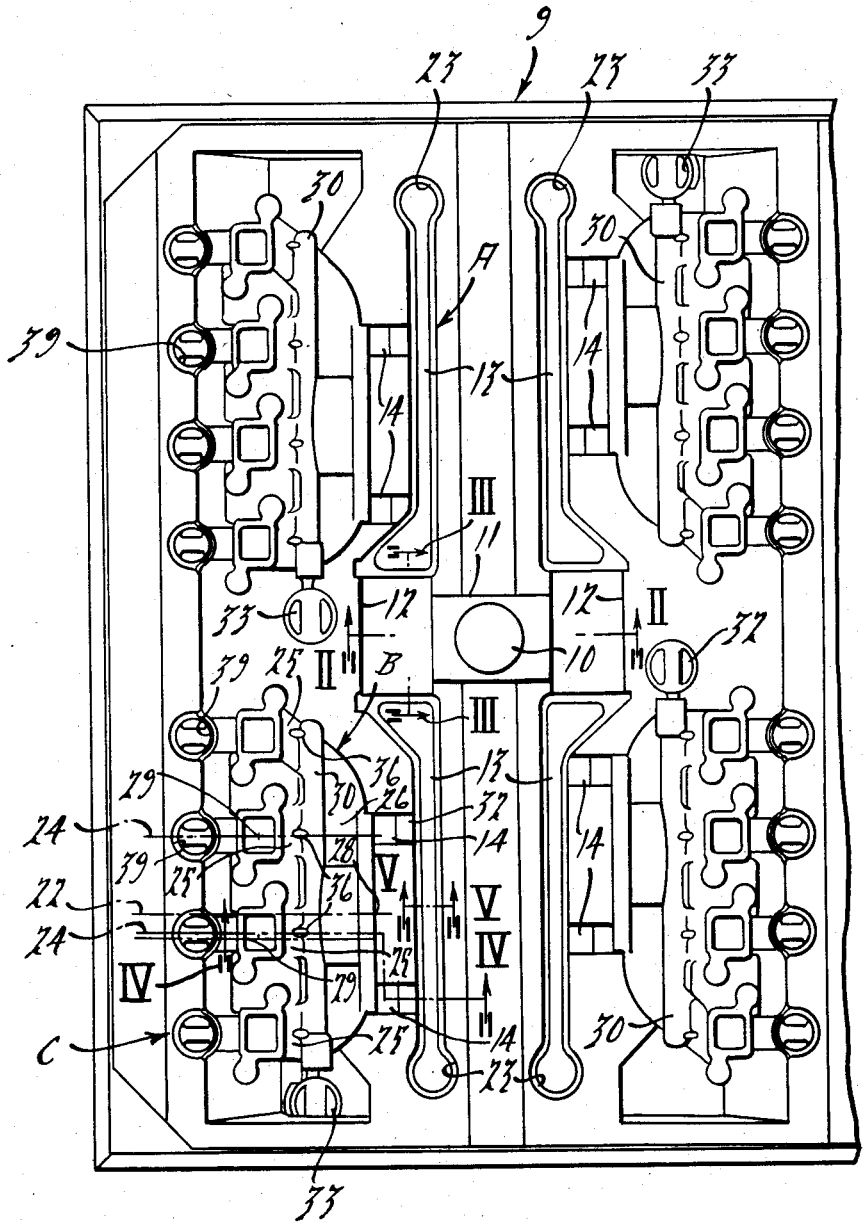
FIG. 1 is a schematic plan view of a mold assembly arranged to provide multiple casting cavities.
Figure 2:
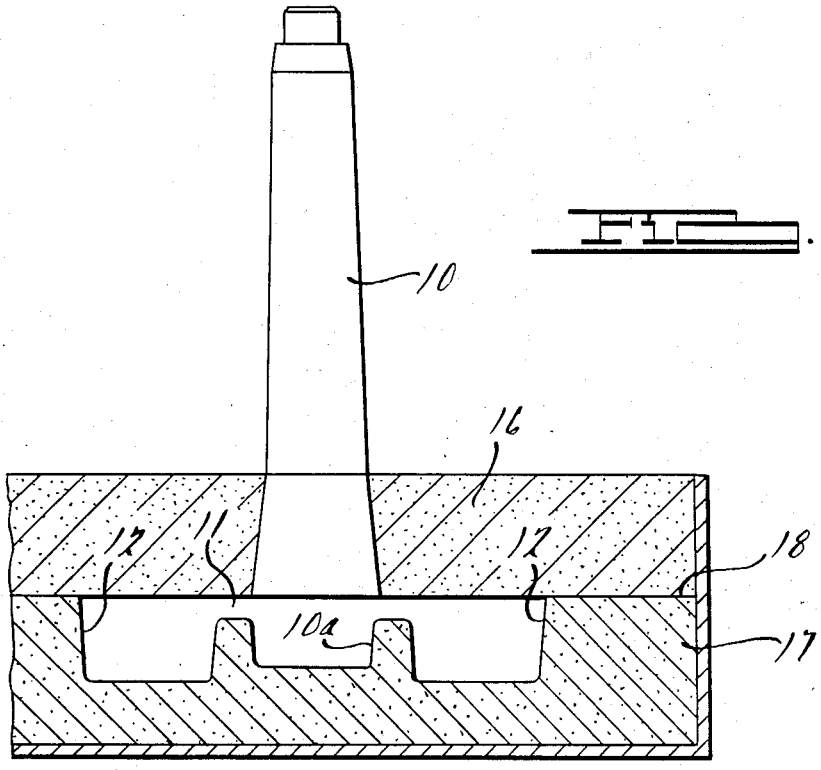

A preferred prepared mold for implementing the method of this invention is illustrated in FIG. 1. The mold 9 is comprised essentially of bonded sand with prepared openings and spaces which comprise a delivery system A, mold cavity B, and flow-off spaces C. The mold is designed to produce at least one casting, but can be designed preferably to produce a plurality of identical castings; four casting cavities are here poured and fed from a common delivery system. As shown in FIGS. 1 and 2, the mold has a cope 16 and a drag 17 divided along a parting plane 18. The delivery system A consists of a down sprue 10, a sprue well 10*a*, primary horizontal runners 11, at least one treatment chamber 12, secondary horizontal runners 13, and one or more ingates 14 (see FIG. 1) which communicate directly with each molding cavity B.

As shown in FIGS. 2 and 3, the treating chamber 2 is formed as a cubicle in the drag having sloping side walls 15, sloping downwardly and inwardly, making an angle 8 of about 5°–10° with a vertical plane. The cubicle is preferably designed to be filled to a level 7 immediately below the parting plane 18 of the mold, i.e., 0.25 inches therefrom, with a granular nodularizing/inoculating agent. The sloping side walls are advantageous in that they provide a larger surface area of granular agent to be exposed to the leading portion of the molten iron pour, particularly when reactivity is slowest. Progressively, a slightly smaller surface area of granular agent is exposed as the trailing portion of the pour is experienced. In this manner, a more uniform treatment of the molten metal takes place which compensates for slower reactivity initially resulting from thermal transfer requirements.

Figure 5:
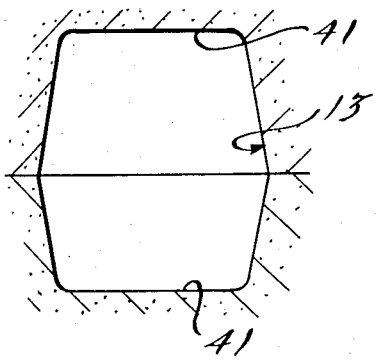
FIG. 5 is a sectional view of the secondary runner taken along line 5—5 of FIG. 1.
Figure 7:
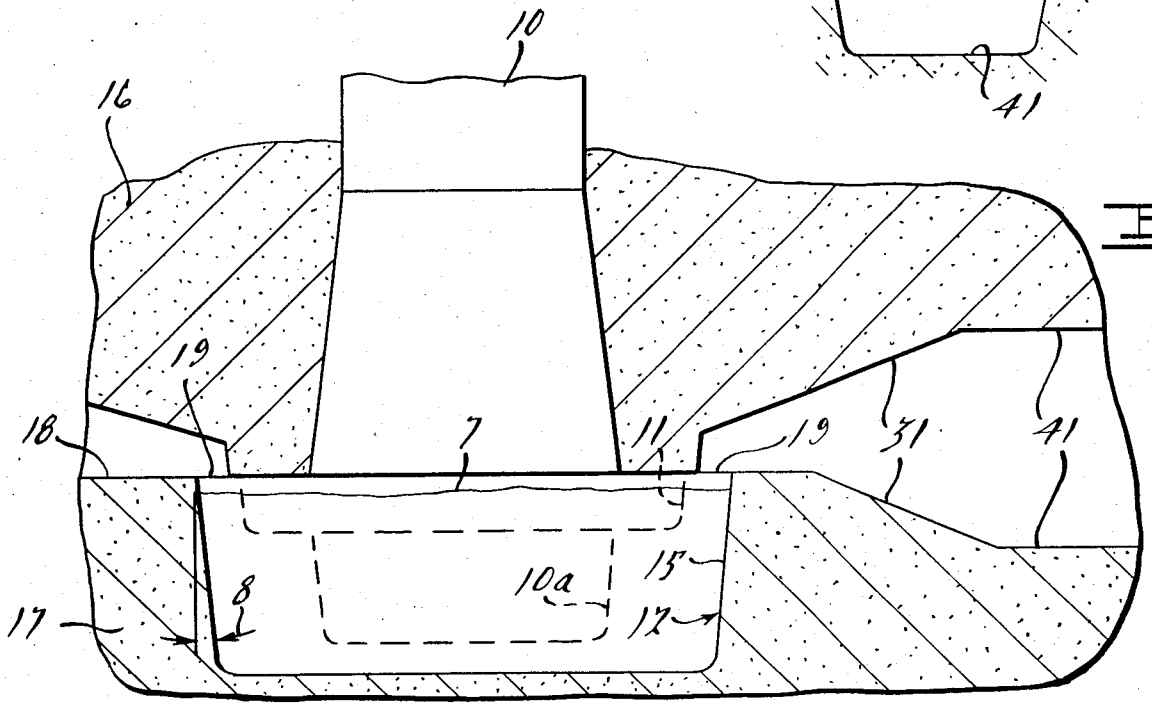

The treating chamber 12 here has a volume, as shown in FIG. 2, of about 32–35 cubic inches. The overlap or mouth area 19 between the treating chamber and secondary runner 13 here is about 1.86 square inches. The secondary runner extends as a generally straight channel from the treating chamber along and parallel to the length of the casting cavity; secondary runner 13 has a general cross-sectional area of about one square inch. The entrance 31 to each secondary runner has diverging upper and lower walls 31 for promoting mixing of the molten metal by local turbulence or vortical flow. The walls 31 merge into flat upper and lower surfaces 41 which promote a streamlined flow through the remainder of the secondary runner. The secondary runner has a tapered cross-sectional configuration as shown in FIG. 5.

Figure 4:
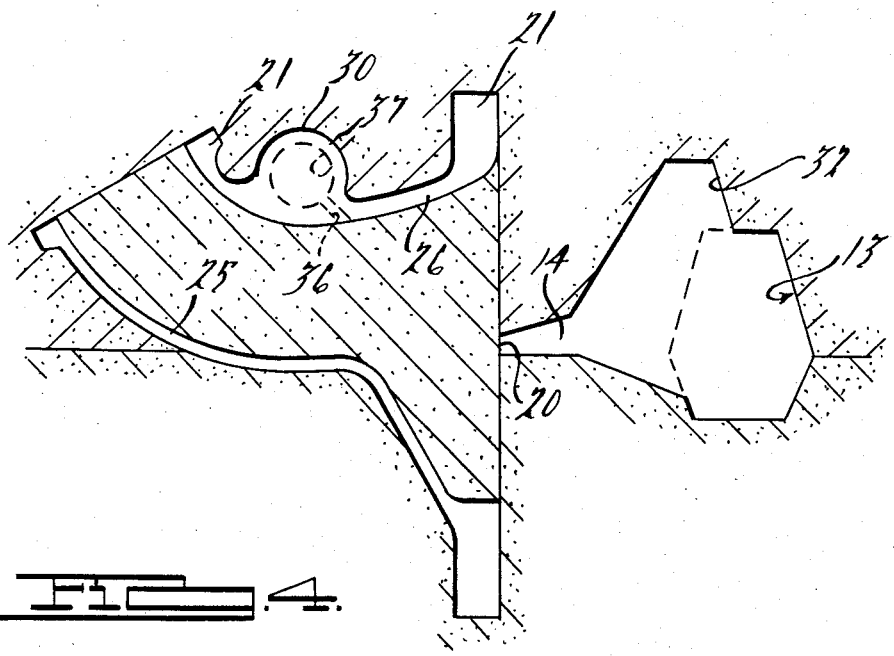
FIG. 4 is a sectional view of the casting cavity and associated ingate taken substantially along line 4—4 of FIG. 1.

The two ingates 14 carry molten iron from the secondary runner 13 to mid-stations 20 of the annular space 21 for defining an outlet duct flange for the casting (see FIGS. 1 and 4). Each ingate 14 has walls defining a riser 32 to promote good pressure head and steady filling. The delivery system of the mold also contains walls defining a blind riser 33 to promote filling at the remote end of the cavity. At the end of each of the secondary runners 13, a well 23 extending between the cope and drag. The well provides for the collection of dross and gases which tend to create porosity in the casting. Although wells have been utilized before by the prior art, the use of the well in this location is unique because it is used at the end of a streamlined flow in the secondary runner 13, which runner has walls contoured at its entrance to induce turbulence and is progressively choked between the entrance and end to insure said streamlined flow.

The mold walls defining casting cavity B, in cooperation with a core 40 (see FIG. 6), is herein designed to produce an automotive exhaust manifold, the manifold having a plurality of tubular spaces 25 for defining a plurality of inlet ducts of the manifold. An elliptical tubular space 26 is used for defining an outlet duct. The inlet and outlet ducts are defined by these thin spaces in the cavity, typically 0.15 inches in thickness and having a length at least 12 times the thickness. Each of the inlet ducts and the outlet duct have enlarged flange spaces 21, 27, respectively, surrounding them. The inlet ducts of the final casting interconnect with the outlet duct substantially along one-half of the sidewall of the outlet duct, such arrangement facilitating shorter inlet ducts and therefore a more compact manifold construction. In keeping with such compact construction, the center 28 of the elliptical outlet opening is generally arranged so that an axis 22 extending therethrough will pass between the extended axes 24 of the centers 29 of the innermost inlet openings for the inlet ducts.

Walls are defined in cavity B to define a rib space 30 which extends transversely across each of the tubular spaces 25. The rib space 30, when occupied by solid metal, provides a mass of material which may be drilled to provide a secondary air channel 37 which then may be further cross-drilled at 36 to communicate with an inlet duct. Importantly, the rib space not only acts as a functional part of the mold to define a useful part of the casting, but also serves as a reservoir of hot molten iron during the pouring of the casting to feed certain portions of the thin wall sections of which the ducts are comprised.

Walls are provided to define flow-off spaces C comprised of wells 39 adjacent each inlet tubular space 25. These spaces 39 are preferably located in the drag portion of the mold adjacent the parting plane.

A preferred method mode for carrying out the present invention using the mold design previously described is as follows:

(a) Molten iron is introduced to the mold assembly, the molten iron being of the type to produce grey iron with flake graphite if solidified. The iron preferably has a chemical content consisting of 3.5–4.2% C, 1.5–2.4% Si, no greater than 0.065% carbide formers, and the remainder essentially iron. While in the delivery system, the molten iron is brought into contact with a nodularizing/inoculating agent as it passes to the mold cavity. The mold cavity, such as that in FIG. 1, is designed to produce an automotive engine exhaust manifold weighing approximately 6–11 lbs. (depending on design) and requires a molten metal charge of about 42 lbs.

To provide a proper mass flow with the molten metal held within the desired temperature range of 2630°–2760° F., the pouring of such charge of molten iron metal is carried out within a time period of 4.5–5.5 seconds. The molten metal charge is poured into the down sprue 10 which leads to a primary horizontal runner 11 which leads into the treatment chamber 12 containing a treating agent in the form of a granulated magnesium/ferro/silicon alloy. Preferably, the granulated alloy has a chemical content of 6% magnesium, 47% silicon, and 47% iron. The agent is added in amount of 0.5–1% of the molten iron charge.

As the molten iron metal flows across the granulated alloy, there is an immediate chemical reaction with silicon seeding the molten metal and magnesium forming a vapor which dissolves within the molten metal to react with the free carbon and provide a graphitizing effect about the seeds. After passing through the treatment chamber, the treated molten metal enters the secondary horizontal runner 13 which contains diverging walls 31 in the entrance to stimulate vortical or turbulent flow for mixing the treated molten metal. In this manner, any unreacted treating (nodularizing/inoculating) agent may be properly stirred and caused to more uniformly distribute itself throughout the charge, thereby improving homogeniety of the treated metal. This ensures better graphitizing and inoculation which determines to some extent the microstructure of the final casting, and particularly the degree of carbides in the thin wall section.

Ingates 14 are arranged so that the molten metal will flow from the delivery system in a restricted manner to two desired stations at flange space 21 of the casting cavity (see FIGS. 1 and 4).

(b) The treated molten iron is fed to the mold cavity B and into one extremity of a thin space of said cavity. For purposes of this embodiment, the thin casting cavity space is that which defines the tubular outlet space 26 and the tubular inlet spaces 25. These spaces are 0.20 inches or less and preferably maintained within a thickness range of 0.12–0.15 inches, while the thickness of the flange spaces 21 or 27 is considerably greater. The thin tubular spaces preferably have a length at least 12 times the thickness thereof which presents a difficult flow throat. The thin space for the outlet duct interconnects with each of the thin spaces for the inlet ducts; this requires interdependency of feeding from one to the other in order to complete the casting.

(c) A reservoir of molten metal is created in rib space 30 at a mid-station of the thin spaces 25 to act as a hot supply of molten metal for feeding the remainder of the thin spaces and other connected cavity portions. The reservoir additionally serves as an integral functional part of the casting when solidified. For this specific embodiment, the reservoir when solidified forms a cylindrical body or rib of metal extending tangentially across each of the inlet ducts at a mid-station thereof. Thus, when molten metal is fed to the casting cavity, the molten metal will pass from flange 21 into and through the first half portion of the thin wall spaces 26–25 and then enter the reservoir space 30 defining the rib while it is still hot and not unduly chilled by the mold walls. The reservoir is intermediate the length of the thin spaces 25 and serves as a supply of hot metal which can be fed to the remainder of the thin spaces 25 and other connected spaces (27, etc.). In this manner, proper filling of the entire casting is assured with hot metal and the risk of cold shutting of the thin spaces by premature cooling is avoided. In addition, the creation of excess carbides as a result of quick chilling in such thin spaces is also avoided.

By use of the above method, the cooling rate of the metal in the thin spaces is primarily controlled through the use of a reservoir of hot metal which is stationed at a midpoint of the flow through the casting. The microstructure of the resulting casting is controlled by the use of chemical constituents which produce a ferritic matrix with a high nodularity. It is preferable to control the chemistry of the resultant iron so that it contains at least 3.5, desirably 3.9% C, and at least 1.9, desirably 2.9% Si. In so doing, the molten metal is assured of greater fluidity as it passes through the thin spaces and the tendency to formation of carbides is reduced.

To additionally reduce the formation of carbides, carbide formers such as manganese and chromium are limited (0.46–0.52% manganese, 0.16–0.19% chromium), with the total content of the carbide formers being limited to no greater than 0.65%. In this manner, the matrix is assured of being principally ferrite with minor portions of pearlite and a controlled carbide content. The reduction of carbides is further assured by promoting greater mixing of the nodularizing agents so that it functions to seed the molten metal for creation of more graphite nodules and to shape their structure more effectively. This, as indicated earlier, is promoted by the use of secondary flow turbulizers in the secondary runners of the delivery system.

Figure 6:
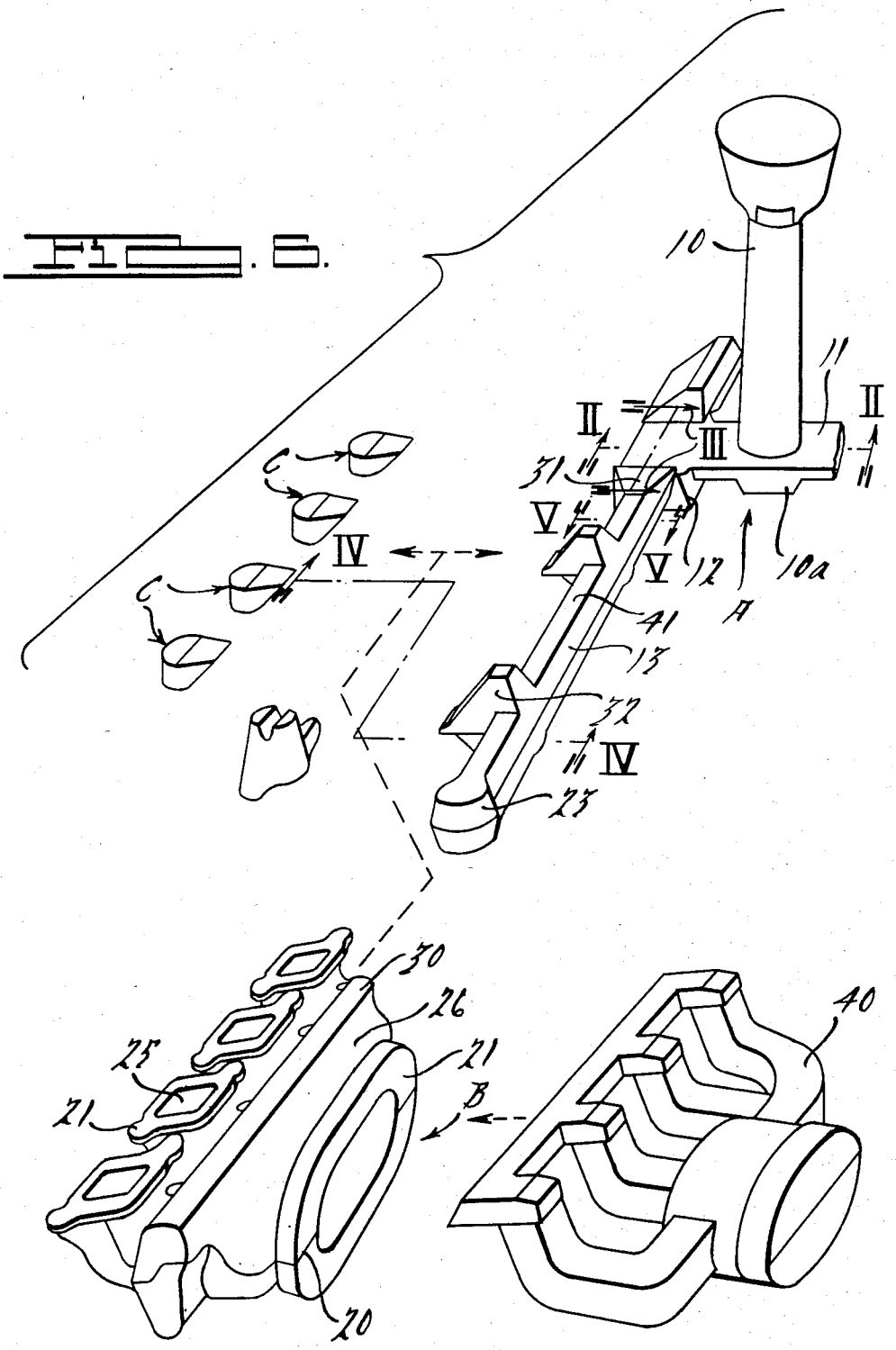
FIG. 6 is an exploded perspective view of the resulting cast metal produced by using the mold of FIG. 1.

FIG. 6 illustrates the shape of the cast metal, when solidified, separately showing the delivery system A, casting B, and flow-off spaces C, and a core 40 which is inserted in the mold to shape the internal surfaces of the casting. The solid metal is identified with reference numbers corresponding to the mold walls forming such metal.

We claim:

1. A method of making a ductile iron casting in a mold assembly having walls defining first and second casting cavity portions with at least one thin space interconnecting said cavity portions, said thin space having a cross-sectional thickness dimension of 0.2 inches or less and a length of at least 12 times said dimension, and said thin space being the sole conduit for filling the second of the cavity portions, the method comprising:

(a) introducing molten iron, of the type that would form gray iron with flake graphite if solidified untreated, to said mold assembly and, while in said mold assembly, treating said molten iron with a nodularizing/inoculating agent prior to the molten metal passing into the cavity portions;

(b) feeding the treated molten iron into said first mold cavity portion and thence into one extremity of said thin space; and (c) while continuing to feed said treated molten iron to fill said mold assembly, creating a reservoir of treated molten iron at about a midstation of said thin space to be in series between said one extremity of said thin space and the remainder of said thin space and second cavity portion, said reservoir feeding molten iron to said remainder of the thin space after having passed from said one extremity, said reservoir also serving as an integral functional part of the casting when solidified.

* * * * *